US010724282B2

(12) United States Patent
Seo

(10) Patent No.: US 10,724,282 B2
(45) Date of Patent: Jul. 28, 2020

(54) OPENING AND CLOSING MECHANISM FOR OPENING AND CLOSING BODIES

(71) Applicants: HI-LEX CORPORATION, Hyogo (JP); DAIWA INDUSTRIES LTD., Osaka (JP)

(72) Inventor: Ken-ichiro Seo, Hyogo (JP)

(73) Assignee: DAIWA INDUSTRIES LTD. (JP)

( * ) Notice: Subject to any disclaimer, the term of this patent is extended or adjusted under 35 U.S.C. 154(b) by 138 days.

(21) Appl. No.: 16/070,473

(22) PCT Filed: Jan. 18, 2017

(86) PCT No.: PCT/JP2017/001599
§ 371 (c)(1),
(2) Date: Jul. 16, 2018

(87) PCT Pub. No.: WO2017/126567
PCT Pub. Date: Jul. 27, 2017

(65) Prior Publication Data

US 2019/0024426 A1 Jan. 24, 2019

(30) Foreign Application Priority Data

Jan. 18, 2016 (JP) ..... 2016-007445

(51) Int. Cl.
*E05D 15/10* (2006.01)
*E06B 3/46* (2006.01)
*E05F 15/646* (2015.01)

(52) U.S. Cl.
CPC ..... *E05D 15/1042* (2013.01); *E05D 15/10* (2013.01); *E05F 15/646* (2015.01); (Continued)

(58) Field of Classification Search
CPC ..... E05D 15/1042; E05D 2015/1057
See application file for complete search history.

(56) References Cited

U.S. PATENT DOCUMENTS 304,222 A * 8/1884 Morrison ..... E05D 15/1042 49/130
4,544,198 A * 10/1985 Ochiai ..... B60J 5/0479 296/155

(Continued)

FOREIGN PATENT DOCUMENTS

CN 1128491 8/1996
CN 1207793 2/1999

(Continued)

OTHER PUBLICATIONS

International Search Report, International Application No. PCT/JP2017/001599 dated Mar. 14, 2017.

*Primary Examiner* — Catherine A Kelly
(74) *Attorney, Agent, or Firm* — Perman & Green, LLP

(57) ABSTRACT

The opening and closing mechanism for opening and closing bodies has a first opening and closing body, a second opening and closing body, a first support member, a second support member, a first and second guide member, wherein a first and a second guide member intermediate portion are disposed to have an overlapping region, in the overlapping region, one of the first guide member intermediate portion and the second guide member intermediate portion is arranged, with respect to the other of the first guide member intermediate portion and the second guide member intermediate portion, in a direction to which a load is applied, and each of the first to fourth connecting portions has a rolling element provided at a side so as to apply a load toward toe guide members.

5 Claims, 13 Drawing Sheets

(52) U.S. Cl.
CPC ..... *E06B 3/46* (2013.01); *E06B 3/4645* (2013.01); *E05D 2015/1055* (2013.01); *E05D 2015/1057* (2013.01); *E05Y 2201/684* (2013.01); *E05Y 2900/531* (2013.01)

(56) References Cited

U.S. PATENT DOCUMENTS

| | | | | |
|---|---|---|---|---|
| 4,565,031 | A * | 1/1986 | Sakamoto | E05D 15/1042 49/127 |
| 5,417,272 | A | 5/1995 | Marlowe et al. | |
| 6,073,674 | A | 6/2000 | Hörmann | |
| 7,647,728 | B2 * | 1/2010 | Bortoluzzi | E05D 15/10 49/209 |
| 8,113,607 | B2 * | 2/2012 | Slager | E05B 65/0882 292/137 |
| 8,984,810 | B2 * | 3/2015 | Bortoluzzi | E05D 15/1042 312/139 |
| 9,157,264 | B2 * | 10/2015 | Bortoluzzi | E05D 15/063 |
| 9,739,080 | B2 * | 8/2017 | Yoon | E05D 15/1042 |
| 10,000,962 | B2 * | 6/2018 | Berger | E05D 15/1042 |
| 10,087,667 | B2 * | 10/2018 | Girotto | E05D 15/1065 |
| 2010/0199563 | A1 * | 8/2010 | Bortoluzzi | E05D 15/08 49/128 |
| 2013/0020918 | A1 * | 1/2013 | Mascheroni | E05D 15/1042 312/319.1 |

FOREIGN PATENT DOCUMENTS

| | | | | |
|---|---|---|---|---|
| DE | 1166429 | B * | 3/1964 | E06B 3/4636 |
| EP | 2525035 | A2 * | 11/2012 | E05D 15/1042 |
| GB | 871745 | A * | 6/1961 | E06B 3/4672 |
| JP | 3284894 | | 5/2002 | |
| JP | 2005179893 | | 7/2005 | |
| JP | 20062419 | | 1/2006 | |
| JP | 2006241906 | | 9/2006 | |
| JP | 4200468 | B1 * | 12/2008 | E05D 15/1042 |
| JP | 2010105547 | | 5/2010 | |
| JP | 5219733 | | 6/2013 | |

* cited by examiner

OPENING AND CLOSING MECHANISM FOR OPENING AND CLOSING BODIES

CROSS REFERENCE TO RELATED APPLICATIONS

This application is the National Stage of International Application No. PCT/JP2017/001599, having an International Filing Date of 18 Jan. 2017, which designated the United States of America, and which International Application was published under PCT Article 21 (2) as WO Publication No. 2017/126567 A1, and which claims priority from and the benefit of Japanese Application No. 2016-007445, filed on 18 Jan. 2016, the disclosures of which are incorporated herein by reference in their entireties.

TECHNICAL FIELD

The present invention relates to an opening and closing mechanism for opening and closing bodies which can be opened and closed in a double-sliding manner.

BACKGROUND OF THE INVENTION

An opening and closing mechanism for opening and closing bodies for opening and closing a plurality of opening and closing bodies (for example, shoji, doors, etc.) is known. Patent Document 1 discloses a sliding door device as an example of such an opening and closing mechanism for opening and closing bodies. This sliding door device comprises a running body running in the right and left directions, a left guide body and a right guide body which are mounted on the running body rotatably in the left and right directions, a sliding door mounting body having a left roller running along the left guide body and a right roller running along the right guide body, a sliding door mounted on the sliding door mounting body, and a biasing means provided between the running body and the sliding door mounting body and biasing the sliding door mounting body backward. This sliding door device assures that a smooth movement of the sliding door mounting body can be achieved and operability of the sliding door can be improved.

PRIOR ART DOCUMENT

Patent Document

Patent Document 1: JP 5219733 B

SUMMARY OF THE INVENTION

Problem to be Solved by the Invention

However, in the sliding door device of Patent Document 1, a front side guide rail and a back side guide rail are provided separated from each other in a direction parallel to a direction of the sliding door separating from an opening. Therefore, since the running body running while being engaged with the both guide rails receives a rotation moment by a weight of the sliding door, a load is applied to the running body in a width direction of the guide rails. Thus, it is difficult for the running body to move smoothly at a portion where an extending direction of the guide rail is changed, such as a circular arc guide.

An object of the present invention is to provide an opening and closing mechanism for opening and closing bodies which the opening and closing bodies can move easily and smoothly when they are moved.

Means to Solve the Problem

An opening and closing mechanism for opening and closing bodies comprises an opening member having a first opening and a second opening, a first opening and closing body being movable between an opened position where the first opening is opened and a closed position where the first opening is closed, a second opening and closing body being movable between an opened position where the second opening is opened and a closed position where the second opening is closed, a first support member which is mounted to the first opening and closing body and supports the first opening and closing body, a second support member which is mounted to the second opening and closing body and supports the second opening and closing body, and guide members which are provided to the opening member, and which guide the first opening and closing body and the second opening and closing body via the first support member and the second support member such that the first opening and closing body and the second opening and closing body is reciprocally movable between the opened position and the closed position, respectively. The guide members have a first guide member and a second guide member, each of the first guide member and the second guide member extending from the first opening side to the second opening side of the opened member. The first support member has a first connecting portion connected movably relative to the first guide member and a second connecting portion connected movably relative to the second guide member. The second support member has a third connecting portion connected movably relative to the first guide member and a fourth connecting portion connected movably relative to the second guide member. The first guide member has a first closed position guide portion guiding the first connecting portion so that the first opening and closing body moves to the closed position where the first opening is closed, a second closed position guide portion guiding the third connecting portion so that the second opening and closing body moves to the closed position where the second opening is closed, and a first guide member intermediate portion which is connected to the first closed position guide portion and the second closed position guide portion, and on which the first connecting portion and the third connecting portion can move. The second guide member has a third closed position guide portion guiding the second connecting portion so that the first opening and closing body moves to the closed position where the first opening is closed, a fourth closed position guide portion guiding the fourth connecting portion so that the second opening and closing body moves to the closed position where the second opening is closed, and a second guide member intermediate portion which is connected to the third closed position guide portion and the fourth closed position guide portion, and on which the second connecting portion and the fourth connecting portion can move. The first guide member intermediate portion and the second guide member intermediate portion are disposed in parallel with each other and are disposed to have an overlapping region. In the overlapping region, one of the first guide member intermediate portion and the second guide member intermediate portion is arranged on the side of the direction which the other of the first guide member intermediate portion and the second guide member intermediate portion receives a load of the first opening and closing body and the second opening and closing body from each of the connecting portions. Each of the first connecting portion, the second connecting portion, the third connecting portion and the fourth connecting portion has a rolling element provided at a side where they apply a load to the guide members. The first support member and the second support member are mounted at positions where, when one of the first opening and closing body and the second opening and closing body is located at the closed position, the other of the first opening and closing body and the second opening and closing body is movable in a double-sliding manner.

Effects of the Invention

According to the opening and closing mechanism for opening and closing bodies of the present invention, the opening and closing bodies can be moved smoothly when moved.

EMBODIMENT FOR CARRYING OUT THE INVENTION

An opening and closing mechanism for opening and closing bodies according to an embodiment of the present invention will be described below with references to the drawings.

First Embodiment

Figure 1:
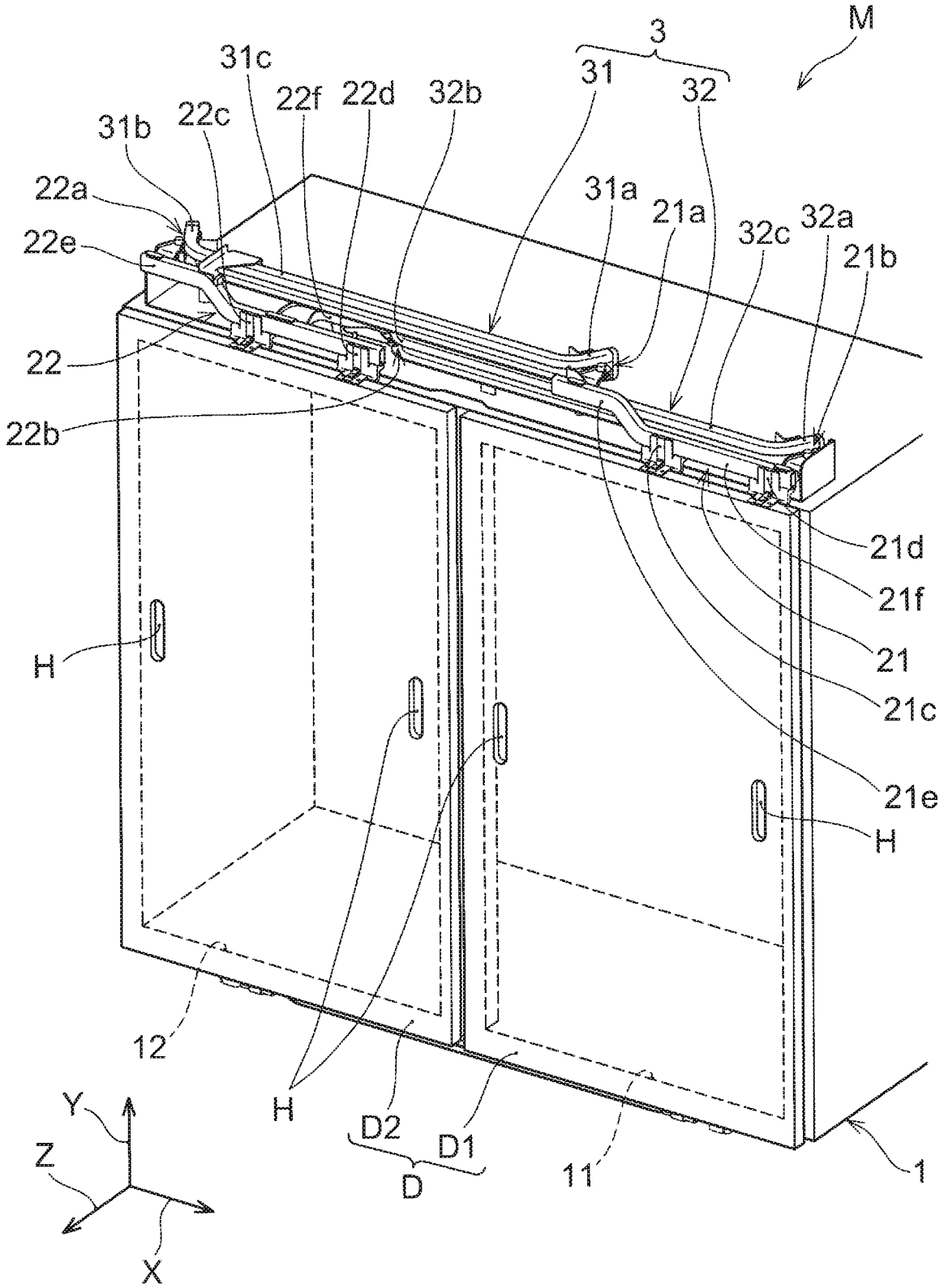
FIG. 1 is a perspective view of an opening and closing mechanism for opening and closing bodies according to a first embodiment of the present invention.

As shown in FIG. 1, an opening and closing mechanism M for opening and closing bodies according to this embodiment comprises an opened member 1 having a first opening 11 and a second opening 12, a first opening and closing body D1 being movable between an opened position where the first opening 11 is opened and a closed position where the first opening 11 is closed, and a second opening and closing body D2 being movable between an opened position where the second opening 12 is opened and a closed position where the second opening 12 is closed.

The opening and closing mechanism M for opening and closing bodies is a mechanism for allowing the first opening and closing body D1 and the second opening and closing body D2 (hereinafter simply collectively referred to as an opening and closing body D) to be moved in a double-sliding manner to open and close the first opening 11 and the second opening 12. Use of the opening and closing mechanism M for opening and closing bodies is riot limited particularly, and the opening and closing mechanism M for opening and closing bodies can be applied to, for example, a door mechanism of a structure housing objects such as a refrigerator or a freezer for business use.

As shown in FIG. 1, the opening member 1 has the first opening 11 and the second opening 12. The first opening 11 and the second opening 12 are opened and closed by means of the first opening and closing body D1 and the second opening and closing body D2, respectively. In this embodiment, the opening member 1 is a casing having an accommodation portion inside thereof as shown in FIG. 1. More specifically, the opening member 1 is a casing having a shape of a substantially rectangular parallelepiped having front, back, top and bottom surfaces and a pair of side surfaces, and has the first opening 11 and the second opening 12 on its front surface side. Note that, in this specification, a moving direction where the opening and closing body D moves for opening and closing is referred to as a moving direction X of the opening and closing body D, a vertical direction is referred to as an up-and-down direction Y, and a direction perpendicular to both of the moving direction X and the up-and-down direction Y is referred to as a front-back direction Z (see FIG. 1). The shape of the opening member 1 is not limited to the shape shown in the drawing. The opening member 1 may be a casing having a shape other than a substantially rectangular parallelepiped or may be a frame or the like having the first opening 11 and the second opening 12.

In this embodiment, as shown in FIG. 1, the first opening 11 and the second opening 12 are disposed adjacent to each other via a partition portion P (see FIG. 3) in a left-right direction in FIG. 1. Each of the first opening 11 and the second opening 12 of this embodiment is formed into a substantially rectangular shape. However, the shapes of the first opening 11 and the second opening 12 are not limited particularly as long as the first opening 11 and the second opening 12 can be opened and closed by means of the opening and closing bodies.

Figure 2:
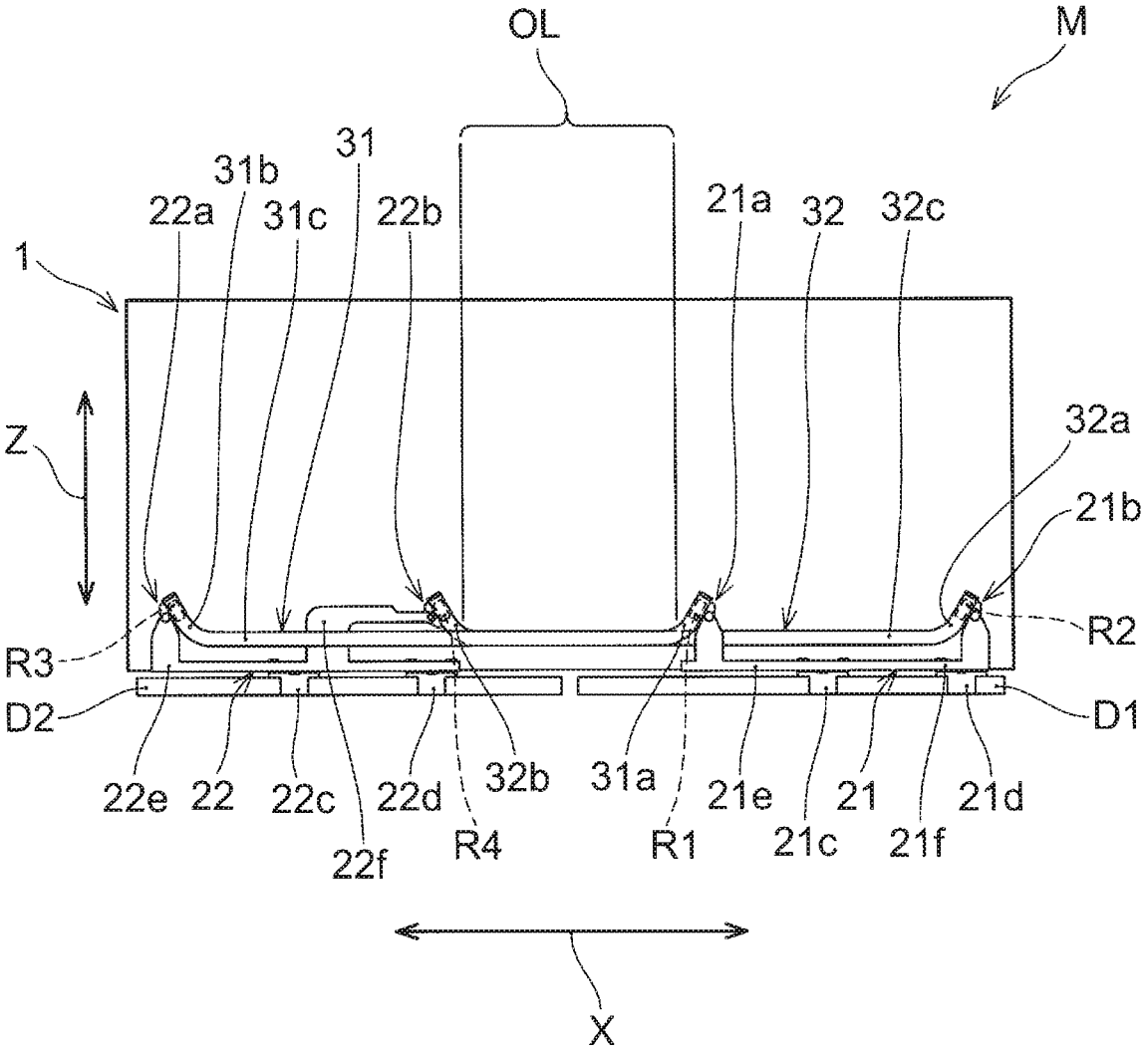
FIG. 2 is a schematic top view of the opening and closing mechanism for opening and closing bodies of FIG. 1.
Figure 4:
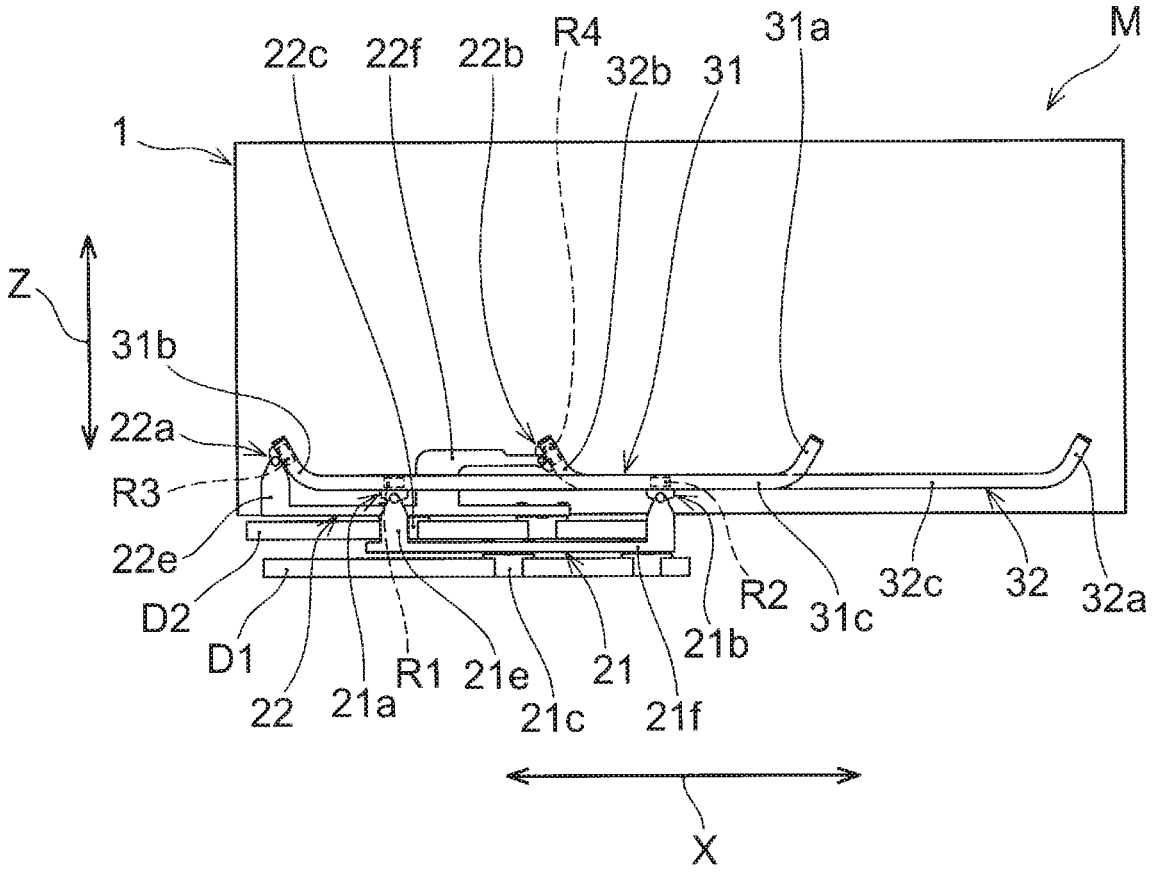
FIG. 4 is a schematic top view illustrating a state where a first opening and closing body was moved to an opened position from the state of FIG. 2.
Figure 5:
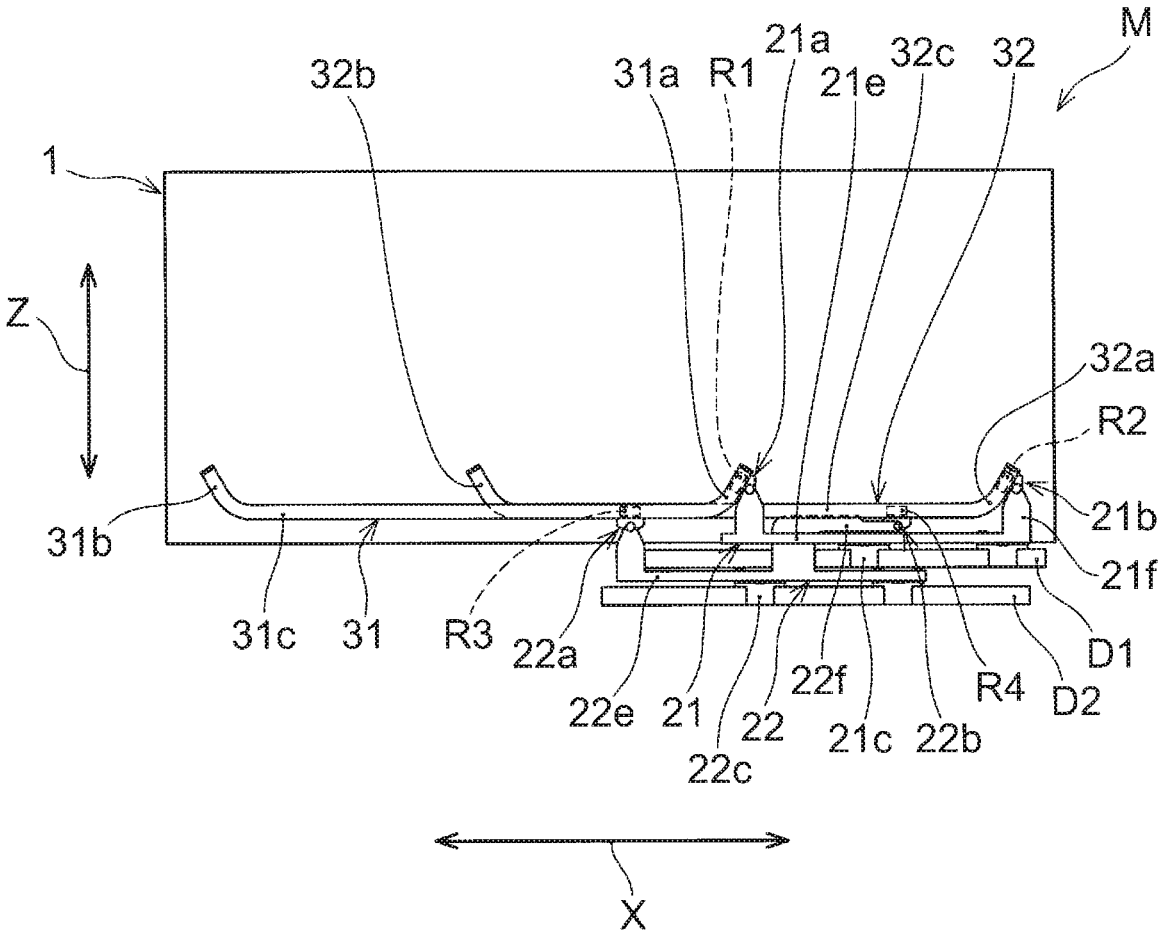
FIG. 5 is a schematic top view showing a state such that a second opening and closing body was moved to an opened position front the state of FIG. 2.

As shown in FIG. 2, FIG. 4 and FIG. 5, each of the first opening and closing body D1 and the second opening and closing body D2 is configured to move between the opened position (see FIG. 4 and FIG. 5) and the closed position (see FIG. 2) in a double-sliding manner. As shown in FIG. 1 and FIG. 2, in the case where both of the first opening and closing body D1 and the second opening and closing body D2 are at the closed positions, the first opening and closing body D1 and the second opening and closing body D2 are arranged side by side with a space therebetween such that the surfaces thereof are substantially on the same plane. Further, in the case where one of the first opening and closing body D1 and the second opening and closing body D2 is located at the closed position and the other of the first opening and closing body D1 and the second opening and closing body D2 moves to the opened position, as shown in FIG. 4 and FIG. 5, the other of the first opening and closing body D1 and the second opening and closing body D2 moves in the front-back direction Z with respect to the surface of the one of the first opening and closing body D1 and the second opening and closing body D2 in addition to the movement in the moving direction X. In this embodiment, as shown in FIG. 1, each of the first opening and closing body D1 and the second opening and closing body D2 is formed into a substantially rectangular plate shape. However, the shapes of the first opening and closing body D1 and the second opening and closing body D2 are not limited particularly as long as the first opening 11 and the second opening 12 can be opened and closed. In this embodiment, note that, as shown in FIG. 1, the first opening and closing body D1 and the second opening and closing body D2 are provided with pulling handles H for manual opening and closing on the front surfaces of the opening and closing bodies D1 and D2, for easy opening and closing of the opening and closing bodies D1 and D2.

Further, as shown in FIG. 1 and FIG. 2, the opening and closing mechanism M for opening and closing bodies comprises a first support member 21 which is mounted on the first opening and closing body D1 and supports the first opening and closing body D1, and a second support member 22 which is mounted on the second opening and closing body D2 and supports the second opening and closing body D2. The first support member 21 and the second support member 22 are mounted at positions where, when one of the opening and closing body D1 and the opening and closing body D2 is located at the closed position, the other of the opening and closing body D1 and the opening and closing body D2 can move in a double-sliding manner. Further, as shown in FIG. 1, the opening and closing mechanism M for opening and closing bodies comprises guide members 3 which are provided to the opening member 1, and which guide the first opening and closing body D1 and the second opening and closing body D2 via the first support member 21 and the second support member 22 such that the opening and closing body D1 and the opening and closing body D2 is reciprocally movable between the opened position and the closed position, respectively. As shown in FIG. 1 and FIG. 2, the guide members 3 have a first guide member 31 and a second guide member 32, each of which extends from the first opening 11 side to the second opening 12 side of the opening member 1.

As shown in FIG. 1 and FIG. 2, the first support member 21 is mounted to the first opening and closing body D1, and connected to both of the first guide member 31 and the second guide member 32. The first support member 21 is guided by the first and second guide members 31, 32 during the movement of the first opening and closing body D1 between the opened position and the closed position. As shown in FIG. 1 and FIG. 2, the first support member 21 has a first connecting portion 21*a* connected movably relative to the first guide member 31 and a second connecting portion 21*b* connected movably relative to the second guide member 32. Further, the first support member 21 has a first mounting portion 21*c* which can be mounted to the first opening and closing body D1. The first support member 21 is mounted to the first opening and closing body D1 via the first mounting portion 21*c*. Thus, the first opening and closing body D1 and the first support member 21 move together between the opened position and the closed position when the first opening and closing body D1 moves for opening and closing. In this embodiment, as shown in FIG. 1 and FIG. 2, the first opening and closing body Di and the first support member 21 are also mounted by an auxiliary mounting portion in addition to the first mounting portion 21*c*. Therefore, the first opening and closing body D1 is mounted to the first support member 21 more stably. Note that, the auxiliary mounting portion 21*d* is an optional part. The first mounting portion 21*c* and the auxiliary mounting portion 21*d* can be mounted to the first opening and closing body D1 by use of widely-known fixing means such as a screw.

Further, in this embodiment, as shown in FIG. 1 and FIG. 2, the first support member 21 comprises a first extending portion 21*e* extending between the first mounting portion 21*c* and the first connecting portion 21*a*, and a second extending portion 21*f* extending between the first mounting portion 21*c* and the second connecting portion 21*b*. The first connecting portion 21*a* is connected swingably relative to the first extending portion 21*e*. The second connecting portion 21*b* is connected swingably relative to the second extending portion 21*f*. The first extending portion 21*e* and the second extending portion 21*f* will be described below.

As shown in FIG. 1 and FIG. 2, the second support member 22 is mounted to the second opening and closing body D2, and connected to both of the first guide member 31 and the second guide member 32. The second support member 22 is guided by the first and second guide members 31, 32 when the second opening and closing body D2 moves between the opened position and closed position. As shown in FIG. 1 and FIG. 2, the second support member 22 has a third connecting portion 22*a* connected movably relative to the first guide member 31 and a fourth connecting portion 22*b* connected movably relative to the second guide member 32. Further, the second support member 22 has a second mounting portion 22*c* to be mounted to the second opening and closing body D2. The second support member 22 is mounted to the second opening and closing body D2 via the second mounting portion 22*c*. Thus, the second opening and closing body D2 and the second support member 22 move together between the opened position and the closed position when the second opening and closing body D2 moves for opening and closing. In this embodiment, the second support member 22 may also be mounted to the second opening and closing body D2 by an auxiliary mounting portion 22*d* in addition to the second mounting portion 22*c* in the same manner as in the first support member 21.

Further, in this embodiment, as shown in FIG. 1 and FIG. 2, the second support member 22 comprises a third extending portion 22*e* extending between the second mounting portion 22*c* and the third connecting portion 22*a*, and a fourth extending portion 22*f* extending between the second mounting portion 22*c* and the fourth connecting portion 22*b*. The third connecting portion 22*a* is connected swingably relative to the third extending portion 22*e*, and the fourth connecting portion 22*b* is connected swingably relative to the fourth extending portion 22*f*. The third extending portion 22*e* and the fourth extending portion 22*f* will be described below.

As shown in FIG. 1 and FIG. 2, the first guide member 31 has a first closed position guide portion 31*a* guiding the first connecting portion 21*a* so that the first opening and closing body D1 moves to the closed position where the first opening 11 is closed, a second closed position guide portion 31*b* guiding the third connecting portion 22*a* so that the second opening and closing body D2 moves to the closed position where the second opening 12 is closed, and a first guide member intermediate portion 31*c* connected to the first closed position guide portion 31*a* and the second closed position guide portion 31*b*, and the first connecting portion 21*a* and the third connecting portion 22*a* are movable on the first guide member intermediate portion 31*c*.

Figure 6:
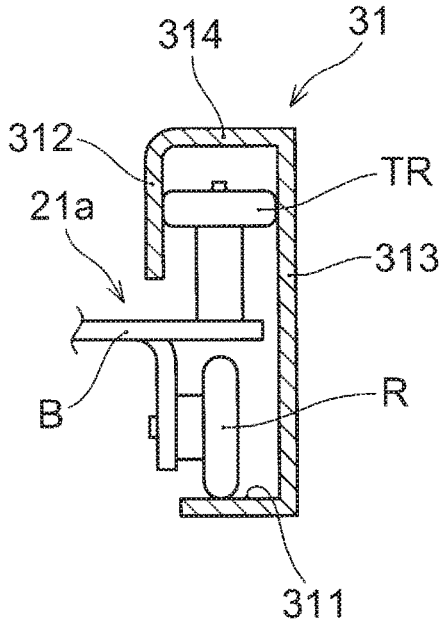
FIG. 6 is a schematic view of a connecting portion used for the opening and closing mechanism for opening and closing bodies of FIG. 1 shown in a moving direction of the opening and closing body.

In this embodiment, as shown in FIG. 1 and FIG. 2, the first guide member 31 is a member in a form of an elongated rail extending along the moving direction X of the opening and closing body D. The first guide member 31 has the first guide member intermediate portion 31*c* extending linearly substantially in parallel with the moving direction X of the opening and closing body D, and the first and second closed position guide portions 31*a*, 31*b*. The first and second closed position guide portions 31*a*, 31*b* are each provided at both ends of the first guide member intermediate portion 31*c* in a longitudinal direction, and extends such that each of the first and second closed position guide portions 31*a*, 31*b* is separated from the opening and closing body D as approaching the ends of the first guide member 31. Further, in this embodiment, as shown in FIG. 6, the cross-section of the first guide member 31 is formed in substantially C-shape. Furthermore, the first guide member 31 is provided in a direction to which a load is applied (downward direction in FIG. 6). The first guide member 31 has a rolling surface 311 on which a rolling element described below rolls, and an engaging portion 312 which engages with the first connecting portion 21*a* and the third connecting portion 22*a* not to come off. More specifically, a cross-section of the first guide member 31 which opens on the opening and closing body D side is formed in substantially C-shape. The first guide member 31 comprises the rolling surface 311 provided at the bottom side thereof, a back surface 313 extending upward from the rolling surface 311, a top surface 314 provided in parallel with the rolling surface 311, and the engaging portion 312 extending downward in a vertical direction from the front side of the top surface 314 and to which a thrust roller TR described below is rollably engaged.

As shown in FIG. 1 and FIG. 2, the second guide member 32 has a third closed position guide portion 32*a* guiding the second connecting portion 21*b* so that the first opening and closing body D1 moves to the closed position where the first opening 11 is closed, a fourth closed position guide portion 32*b* guiding the fourth connecting portion 22*b* so that the second opening and closing body D2 moves to the closed position where the second opening 12 is closed, and an second guide member intermediate portion 32*c* connected to the third closed position guide portion 32*a* and the fourth closed position guide portion 32*b*, and the second connecting portion 21*b* and the fourth connecting portion 22*b* are movable on the second guide member intermediate portion 32*c*. The second guide member 32 and the portions thereof basically have the same configurations as those of the first guide member 31 and the portions thereof, respectively, and therefore, concrete description thereon is omitted.

Figure 7:
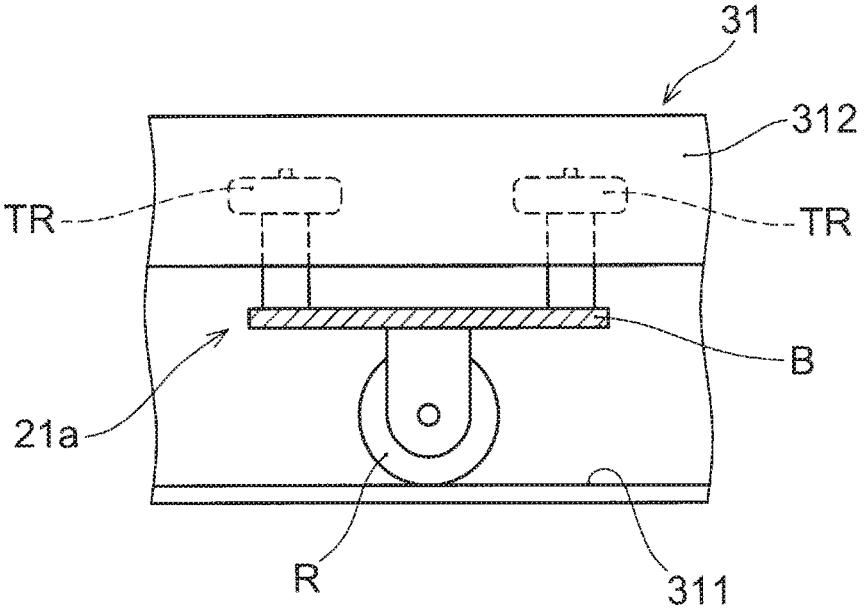
FIG. 7 is a schematic front view of the connecting portion of FIG. 6.
Figure 8:
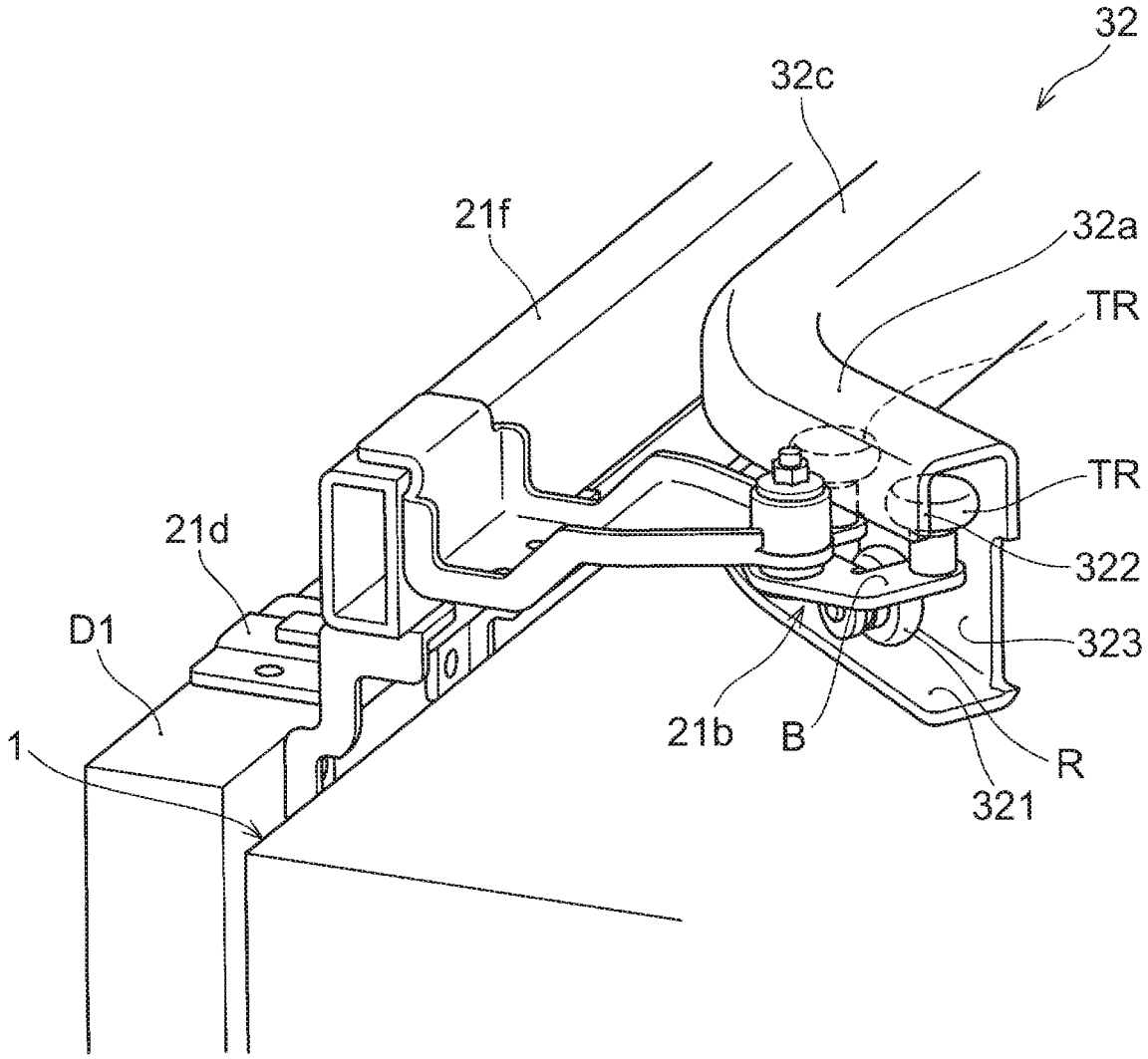
FIG. 8 is a perspective view of a second connecting portion of the opening and closing mechanism for opening and closing bodies of FIG. 1.
Figure 9:
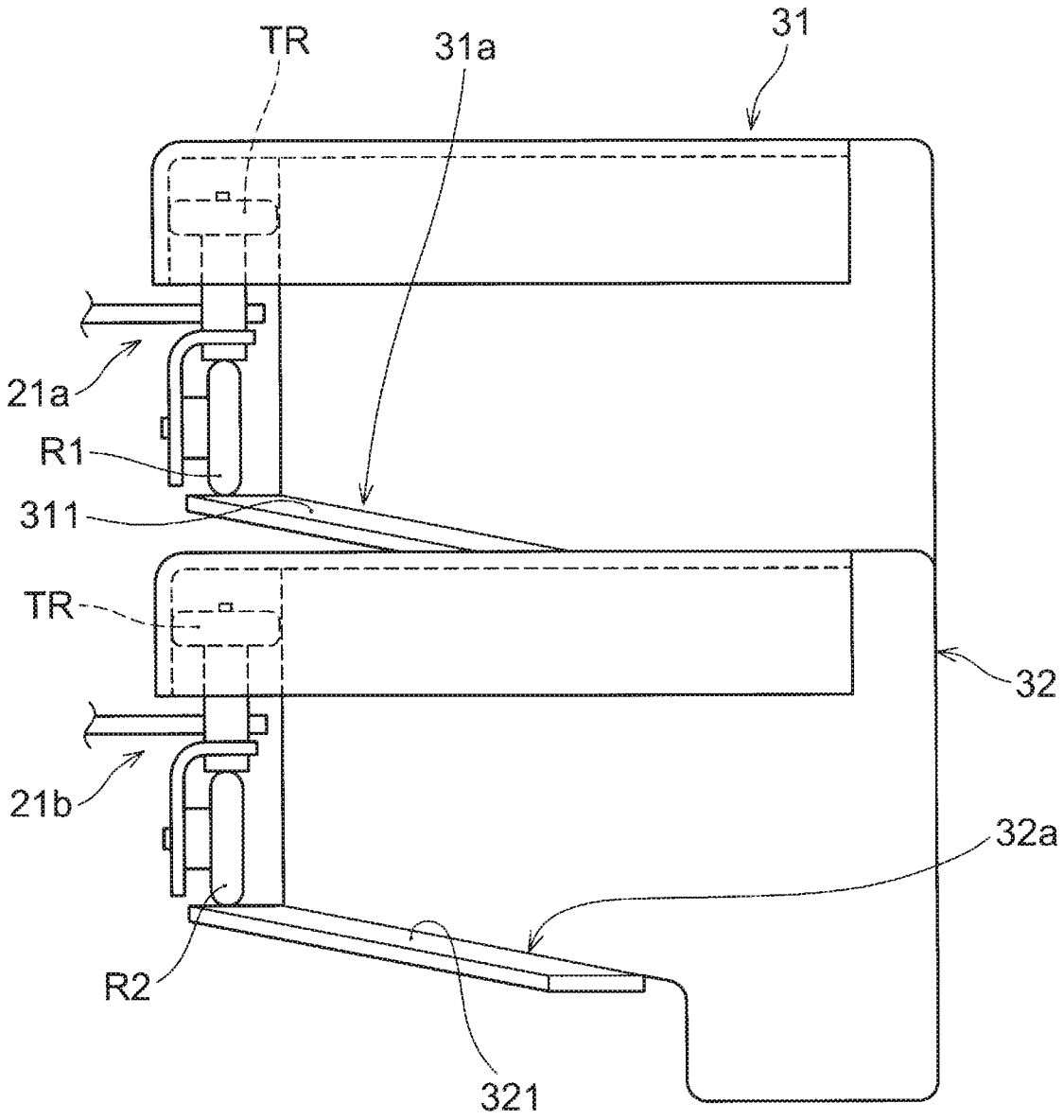
FIG. 9 is a schematic view illustrating a first closed position guide portion and a third closed position guide portion with inclined rolling surfaces of the opening and closing mechanism for opening and closing bodies of FIG. 1.
Figure 10:
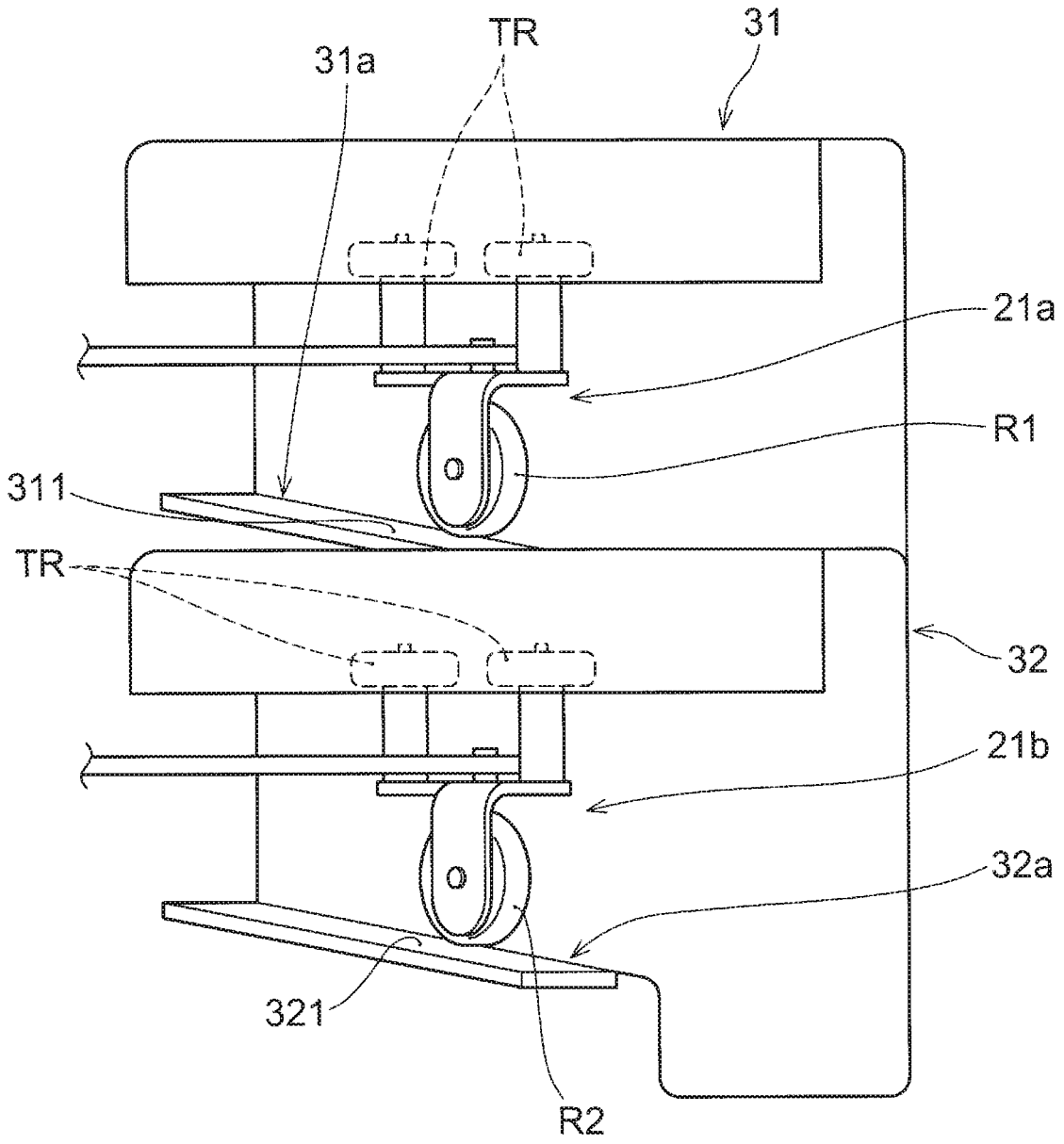
FIG. 10 is a schematic view illustrating a state such that a first connecting portion and a second connecting portion are located on the first closed position guide portion with the inclined rolling surfaces and the third closed position guide portion with the inclined rolling surface as shown in FIG. 9.

As shown in FIG. 2 and FIG. 6 to FIG. 8, the first to fourth connecting portions 21*a*, 21*b*, 22*a*, 22*b* guided by the first guide member 31 and the second guide member 32 have rolling elements R1, R2, R3, R4, respectively (hereinafter may be referred to collectively as the rolling element R). Each of the rolling elements R1, R2, R3, R4 is provided at a side where a load is applied to the guide members 3. Note that, FIG. 6 and FIG. 7 show the first guide member 31 and the first connecting portion 21*a* guided by the first guide member 31, and FIG. 8 shows the second guide member 32 and the second connecting portion 21*b* guided by the second guide member 32, the other connecting portions also have the same configurations. When the first and second opening and closing bodies D1, D2 move along the first and second guide members 31, 32, the rolling elements R roll on the rolling surfaces 311, 321 of the first and second guide members 31, 32. In this embodiment, as shown in FIG. 6 to FIG. 8, each of the first connecting portion 21*a*, the second connecting portion 21*b*, the third connecting portion 22*a* and the fourth connecting portion 22*b* comprises a radial roller rolling element) R receiving a load in a vertical direction and a thrust roller TR receiving a load in a horizontal direction. More specifically, as shown in FIG. 6 to FIG. 8, each of the first to fourth connecting portions 21*a*, 21*b*, 22*a*, 22*b* comprises a base portion B rotatably supporting the radial roller R and the thrust roller TR, the radial roller R mounted to the base portion B rotatably around a horizontal axis, and two thrust rollers TR mounted to the base portion B rotatably around a vertical axis. As shown in FIG. 6 to FIG. 8, the radial rollers R are placed on the rolling surfaces 311 and 321 provided at lower sides of the first and second guide members 31, 32, respectively. Therefore, the thrust rollers TR are disposed between the engaging portions 312, 322 and the back surfaces 313, 323 of the first and second guide members 31, 32, respectively. As shown in FIG. 8, the base portion B is connected swingably around a vertical axis relative to the first to fourth extending portions 21*e*, 21*f*, 22*e*, 22*f*. When the first to fourth connecting portions 21*a*, 21*b*, 22*a*, 22*b* move from the first and second guide member intermediate portions 31*c*, 32*c* to the first to fourth closed position guide portions 31*a*, 31*b*, 32*a*, 32*b*, the first to fourth connecting portions 21*a*, 21*b*, 22*a*, 22*b* swing relative to the first to fourth extending portions 21*e*, 21*f*, 22*e*, 22*f*, respectively. Thus, the rolling elements R of the first to fourth connecting portions 21*a*, 21*b*, 22*a*, 22*b* change directions thereof along the first to fourth closed position guide portions 31*a*, 31*b*, 32*a*, 32*b*, and move smoothly. Note that, in the first to fourth closed position guide portions 31*a*, 31*b*, 32*a*, 32*b*, as shown in FIG. 9 and FIG. 10, the rolling surfaces 311, 321 may have inclinations inclining downward to ends of the each guide portions of the first and second guide members 31, 32. In this case, when the rolling elements R rolls toward the closed position of the opening and closing body D, the rolling element R easily rolls due to gravity. Therefore, the opening and closing body D can be guided to the closed position easily. When the opening and closing body D is located at the closed position, the opening and closing body D is in a state of being pressed to the opening by its own weight. In this case, in order to open the opening, the opening and closing body D needs to move by climbing the first to fourth closed position guide portions 31*a*, 31*b*, 32*a*, 32*b* in which the rolling surfaces 311, 321 are inclined. Therefore, the closed state of the opening and closing body D can be maintained.

Further, as shown in FIG. 1 and FIG. 2, the first guide member intermediate portion 31*c* and the second guide member intermediate portion 32*c* are disposed in parallel with each other, and are arranged so that one of the first guide member intermediate portion 31*c* and the second guide member intermediate portion 32*c* (the second guide member intermediate portion 32*c* in this embodiment) has an overlapping region OL (see FIG. 2). In the overlapping region, one of the first guide member intermediate portion 31*c* and the second guide member intermediate portion 32*c* (the second guide member intermediate portion 32*c* in this embodiment) is arranged at the side, in a direction to which one of the first guide member intermediate portion 31*c* and the second guide member intermediate portion 32*c* (the first guide member intermediate portion 31*c* in this embodiment) receives a load by the first opening and closing body D1 and the second opening and closing body D2 from each of the connecting portions 21*a*, 21*b*, 22*a*, 22*b*, with respect to the other of the first guide member intermediate portion 31*c* and the second guide member intermediate portion 32*c* (the second guide member intermediate portion 32*c* in this embodiment).

As shown in FIG. 2, the overlapping region OL is a region of the first and second guide member intermediate portions 31*c*, 32*c* disposed being overlapped on the side in a direction to which a load of the opening and closing body D is applied (namely downward in the up-and-down direction Y) along a longitudinal direction of the first and second guide member intermediate portions 31*c*, 32*c*. In this embodiment, as shown in FIG. 1 and FIG. 2, the first connecting portion 21*a* and the second connecting portion 21*b* are mounted on the upper side of the first opening and closing body D1, and the third connecting portion 22*a* and the fourth connecting portion 22*b* are mounted on the upper side of the second opening and closing body D2, and the first guide members 31 and the second guide members 32 are disposed being overlapped each other in the up-and-down direction Y. In this embodiment, the first and second guide members 31, 32 are overlapping each other in the up-and-down direction Y, and are disposed linearly along the moving direction X of the opening and closing body D. In the overlapping region OL, a region of the first guide member 31 at the opened position side of the second opening and closing body D2 and a region of the second guide member 32 at the opened position side of the first opening and closing body D1 are overlapped with each other. Therefore, the overlapping region OL is formed in a center part in a longitudinal direction of the whole guide member including the first guide member 31 and the second guide member 32.

By disposing the first guide member 31 and the second guide member 32 so as to have such an overlapping region OL, for example, as compared with the case where the first guide member 31 and the second guide member 32 are disposed horizontally apart from each other in the front-back direction Z (a upward or downward direction in FIG. 2) of the opening member 1, an occupying space of the first guide member 31 and the second guide member 32 in the front-back direction Z can be reduced. Further, it is possible to suppress generation of a large rotation moment around the first to fourth connecting portions 21*a*, 21*b*, 22*a*, 22*b*, which may cause generation of a large friction force between the guide member and the opening and closing body to hinder the movement of the opening and closing body. For example, when other members not shown in the drawing is installed on the top surface or the like of the opening member 1, a wider installation space can be secured. Note that, in this embodiment, the first guide member 31 is disposed on the upper side of the second guide member 32, and the second guide member 32 is disposed on the lower side. However, the first guide member 31 and the second guide member 32 may be disposed reversely, and the second guide member 32 may be disposed above the first guide member 31.

As described above, each of the first to fourth connecting portions 21*a*, 21*b*, 22*a*, 22*b* has a rolling element R on a side where they apply a load to the first and second guide members 31, 32. Therefore, a load of the opening and closing body D supported by the rolling element R is applied to the first and second guide members 31, 32 from the rolling element R toward the same direction, namely downward direction. The first and second guide members 31, 32 continue to receive the downward load by the rolling element R between the closed position and the opened position of the first and second opening and closing bodies D1, D2. Thus, inconsistency of a load-applying direction from the rolling element R to the first and second guide members 31, 32 is suppressed. Therefore, it is possible to suppress rattling of the first to fourth connecting portions 21*a*, 21*b*, 22*a*, 22*b* in the first and second guide members 31, 32 which are caused by inconsistency of a load-applying direction and suppress a friction between the first to fourth connecting portions 21*a*, 21*b*, 22*a*, 22*b* and the first and second guide members 31, 32. Accordingly, the first opening and closing body D1 and the second opening and closing body D2 can be moved smoothly.

Further, as shown in FIG. 4 and FIG. 5, by overlapping the first and second guide members 31, 32 in the up-and-down direction, when one opening and closing body D is moved, separating distances from the opening and closing body D to respective two rolling element R1, R2 (R3, R4) in the front-back direction Z are constant throughout the moving direction of the opening and closing body D. Therefore, an influence of a moment to be applied to the opening and closing body D by a weight of the opening and closing body D remains substantially unchanged between the rolling elements R1, R2 (R3, R4). As a result, when opening and closing the opening and closing body D, two rolling elements R can be moved smoothly along the first and second guide members 31, 32.

Further, in this embodiment, as shown in FIG. 1 to FIG. 5, the first support member 21 has the first extending portion 21*e* extending from the first connecting portion 21*a* in a direction in which the first mounting portion 21*c* is separated from the first guide member 31 when the first opening and closing body D1 is located at the closed position.

The first extending portion 21*e* extends between the first connecting portion 21*a* and the first mounting portion 21*c*. The first extending portion 21*e* extends from the first connecting portion 21*a*, when the first opening and closing body D1 is located at the closed position, toward a direction separated from the first guide member 31. In this embodiment, as shown in FIG. 1, the direction separated from the first guide member 31 includes the moving direction X of the first opening and closing body D1, the up-and-down direction Y which is a load-applying direction and the front-back direction Z which is perpendicular to the moving direction X and the up-and-down direction Y. Specifically, as shown in FIG. 1 and FIG. 2, the first extending portion 21*e* is configured to extend from the first connecting portion 21*a* toward the first opening and closing body D1 side in the front-back direction Z, and then extend toward the closed position side (right side in FIG. 2) in the moving direction X of the first opening and closing body D1 and extend downward in the up-and-down direction Y, thereby reaching the first mounting portion 21*c*.

Further, in this embodiment, as shown in FIG. 1 and FIG. 2, the first support member 21 has a second extending portion 21*f*. The second extending portion 21*f* extends between the second connecting portion 21*b* and the first mounting portion 21*c*. The second extending portion 21*f* extends from the second connecting portion 21*b* toward the first opening and closing body D1 side in the front-back direction Z and then extends to the opened position side in the moving direction X of the first opening and closing body D1. The first extending portion 21*e* and the second extending portion 21*f* extend toward the both sides of the moving direction X of the first opening and closing body D1, respectively, from the first mounting portion 21*c* as a starting point. Accordingly, the first mounting portion 21*c* is arranged in a center region between the first extending portion 21*e* and the second extending portion 21*f* in the moving direction X of the first opening and closing body D1.

Further, in this embodiment, as shown in FIG. 1 and FIG. 2, the second support member 22 has a third extending portion 22*e*. The third extending portion 22*e* extends between the third connecting portion 22*a* and the second mounting portion 22*c*. The third extending portion 22*e* extends from the third connecting portion 22*a* toward the second opening and closing body D2 side in the front-back direction Z and then extends to the opened position side in the moving direction X of the second opening and closing body D2.

Further, as shown in FIG. 1 to FIG. 5, the second support member 22 has a fourth extending portion 22*f*. The fourth extending portion 22*f* is interposed between the second mounting portion 22*c* and the fourth connecting portion 22*b*. In this embodiment, as shown in FIG. 4 and FIG. 5, the fourth extending portion 22*f* extends from the fourth connecting portion 22*b* toward the closed position side in the moving direction X of the second opening and closing body D2 and then extends toward the second opening and closing body D2 side in the front-back direction Z. The third extending portion 22*e* and the fourth extending portion 22*f* extend toward the both sides of the moving direction X of the second opening and closing body D1, respectively, from the second mounting portion 22*c* as a starting point. Accordingly, the second mounting portion 22*c* is arranged in a center region between the second extending portion 22*e* and the fourth extending portion 22*f* in the moving direction X of the second opening and closing body D1.

The fourth extending portion 22*f* is, as shown in, provided so as to extend across the first extending portion 21*e* in the moving direction of the second opening and closing body D2 when the second opening and closing body D2 is located at the opened position. Here, the term "extend across" means that the first extending portion 21*e* and the fourth extending portion 22*f* cross with each other without contact between the first support member 21 and the second support member 22 until the second opening and closing body D2 moves to and reaches its opened position. Note that, the opening and closing mechanism M for opening and closing bodies is configured that the first opening and closing body D1 and the second opening and closing body D2 moves relatively such that, when the second opening and closing body D2 moves to the opened position, a straight line connecting the first connecting portion 21*a* and a connecting part (the first mounting portion 21*c*) of the first extending portion 21*e* to the first opening and closing body D1 and a straight line connecting the fourth connecting portion 22*b* and a connecting part (the second mounting portion 22*c*) of the fourth extending portion 22*f* to the second opening and closing body D2 extend across with each other.

In this embodiment, as shown in FIG. 1 and FIG. 5, the first extending portion 21*e* extends toward the first guide member 31 disposed on the upper side of the second guide member 32, and the fourth extending portion 22*f* extends toward the second guide member 32 disposed on the lower side of the first guide member 31. When the second opening and closing body D2 moves to the opened position, the fourth connecting portion 22*b* and the fourth extending portion 22*f* move to the opened position side together with the second opening and closing body D2 in the moving direction X, and the fourth connecting portion 22*b* moves over the position of the first connecting portion 21*a* in the moving direction X. When the second opening and closing body D2 is further moved to the opened position side, the fourth extending portion 22*f* extends across the lower side of the first extending portion 21*e* without coming into contact with the first extending portion 21*e*, and the second opening and closing body D2 reaches the opened position. Note that, in this embodiment, a portion extending in the front-back direction Z of the fourth extending portion 22*f* is set to a position so as not to come into contact with the first extending portion 21*e* or the first mounting portion 21*c* until the second opening and closing body D2 is moved to the opened position. The cross between the first extending portion 21*e* and the fourth extending portion 22*f* is not limited to the illustrated embodiment. Either one of the first and fourth extending portions 21*e*, 22*f* may extends below the other of the first and fourth extending portions 21*e*, 22*f*, or one extending portion may extend over the upper side of the other extending portion, so as to prevent interference between the first extending portion 21*e* and the fourth extending portion 22*f*. Further, the shapes of the first and fourth extending portions 21*e*, 22*f* are not limited particularly as long as the first extending portion 21*e* and the fourth extending portion 22*f* can extend across with each other without contact between the first support member 21 and the second support member 22 until moving to the opened position of the second opening and closing body D2.

As described above, since the first extending portion 21*e* and the fourth extending portion 22*f* extend across with each other, as shown in FIG. 4 and FIG. 5, the opening and closing body D can be opened without interference between the first extending portion 21*e* and the fourth extending portion 22*f* when opening the opening and closing body D. By such a configuration that the first extending portion 21*e* and the fourth extending portion 22*f* extend across with each other without interference, a space between the two connecting portions provided on one support member (for example, the third and fourth connecting portions 22*a*, 22*b* in the case of the second support member 22 of the second opening and closing body D2) can be widened. By widening the space between the connecting portions supporting the opening and closing body D, supporting of a weight of the opening and closing body D becomes easy and support state of the opening and closing body D becomes stable. Further, by widening the space between the connecting portions supporting the opening and closing body D, a rotation moment is hardly generated around an axis perpendicular to the surface of the opening and closing body D. As a result, when opening and closing the opening and closing body D, rattling of the opening and closing body D hardly occurs and the opening and closing body D can be moved more smoothly.

Further, in this embodiment, as shown in FIG. 2, since the space between the two connecting portions provided on one support member can be widened by the above-described configuration of the first extending portion 21*e* and the fourth extending portion 22*f*, lengths of the first and second guide members 31, 32 can be shortened. Therefore, according to this embodiment, the opening and closing body D can be supported stably, and in addition, the lengths of the first and second guide members 31, 32 can be shortened, thereby enabling weight reduction and space saving of the opening and closing mechanism M for opening and closing bodies.

Figure 3:
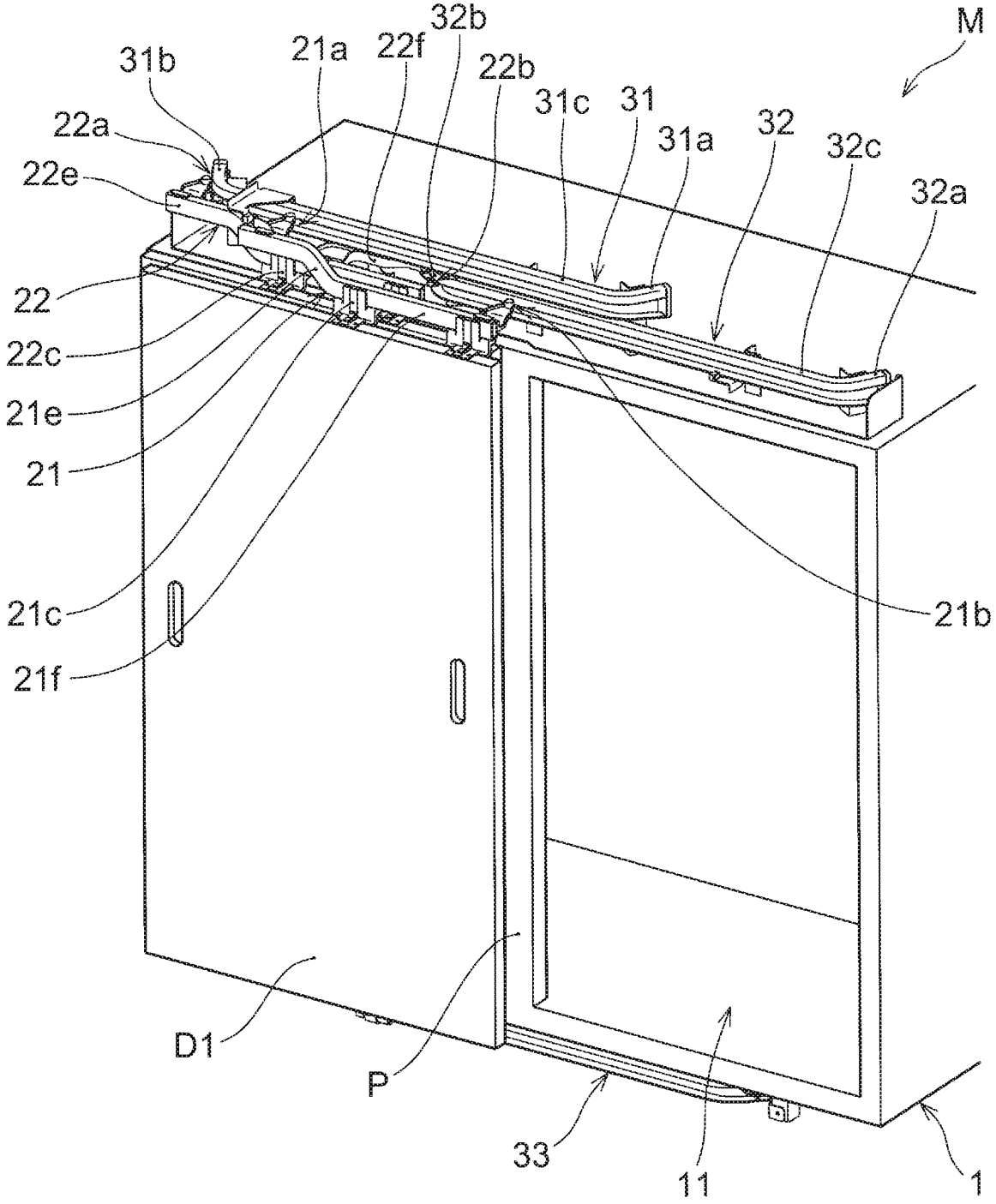
FIG. 3 is a perspective view illustrating a state where a first opening and closing body of the opening and closing mechanism for opening and closing bodies of FIG. 1 is located at an opened position.
Figure 11:
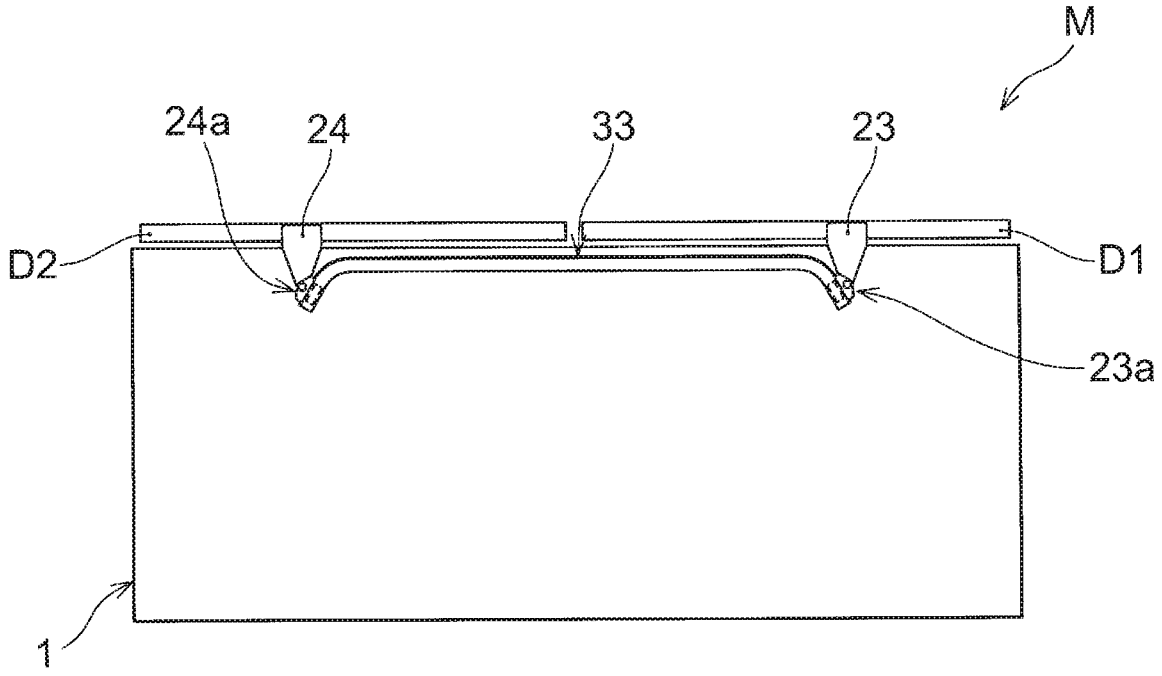
FIG. 11 is a schematic bottom view of the opening and closing mechanism for opening and closing bodies of FIG. 1.

Further, in this embodiment, as shown in FIG. 3 and FIG. 11, the opening member 1 is provided with a third guide member 33 at an opposite side of the opening member 1 to a side at which the first guide member 31 and the second guide member 32 are provided. As shown in FIG. 11, in the first opening and closing body D1, a third support member 23 is mounted at an opposite side to a side at which the first support member 21 is mounted. The third support member 23 has a fifth connecting portion 23*a* which is connected to the third guide member 21. Further, as shown in FIG. 11, in the second opening and closing body D2 a fourth support member 24 is mounted at an opposite side to a side at which the second support member 22 is mounted. The fourth support member 23 has a sixth connecting portion 24*a* which is connected to the third guide member 33.

The third guide member 33 can be configured in the same manner as the first and second guide members 31, 32, and therefore, explanation thereof is omitted. The third and fourth support members 23, 24 connect the first and second opening and closing bodies D1, D2 to the third guide member 33 via the fifth and sixth connecting portions 23*a*, 24*a*. The fifth and sixth connecting portions 23*a*, 24*a* can be configured in the same manner as the second connecting portion 21*b* as shown in FIG. 8, and can be provided with a rolling element R such as a radial roller or the like and a thrust roller TR. The fifth and sixth connecting portions 23*a*, 24*a* move commonly using the third guide member 33 when opening and closing the first and second opening and closing bodies D1, D2. The first and second opening and closing bodies D1, D2 are guided by not only the first and second guide members 31, 32 but also the third guide member 33, and therefore, opening-closing operation of the first and second opening and closing bodies D1, D2 can he performed more stably.

Figure 12:
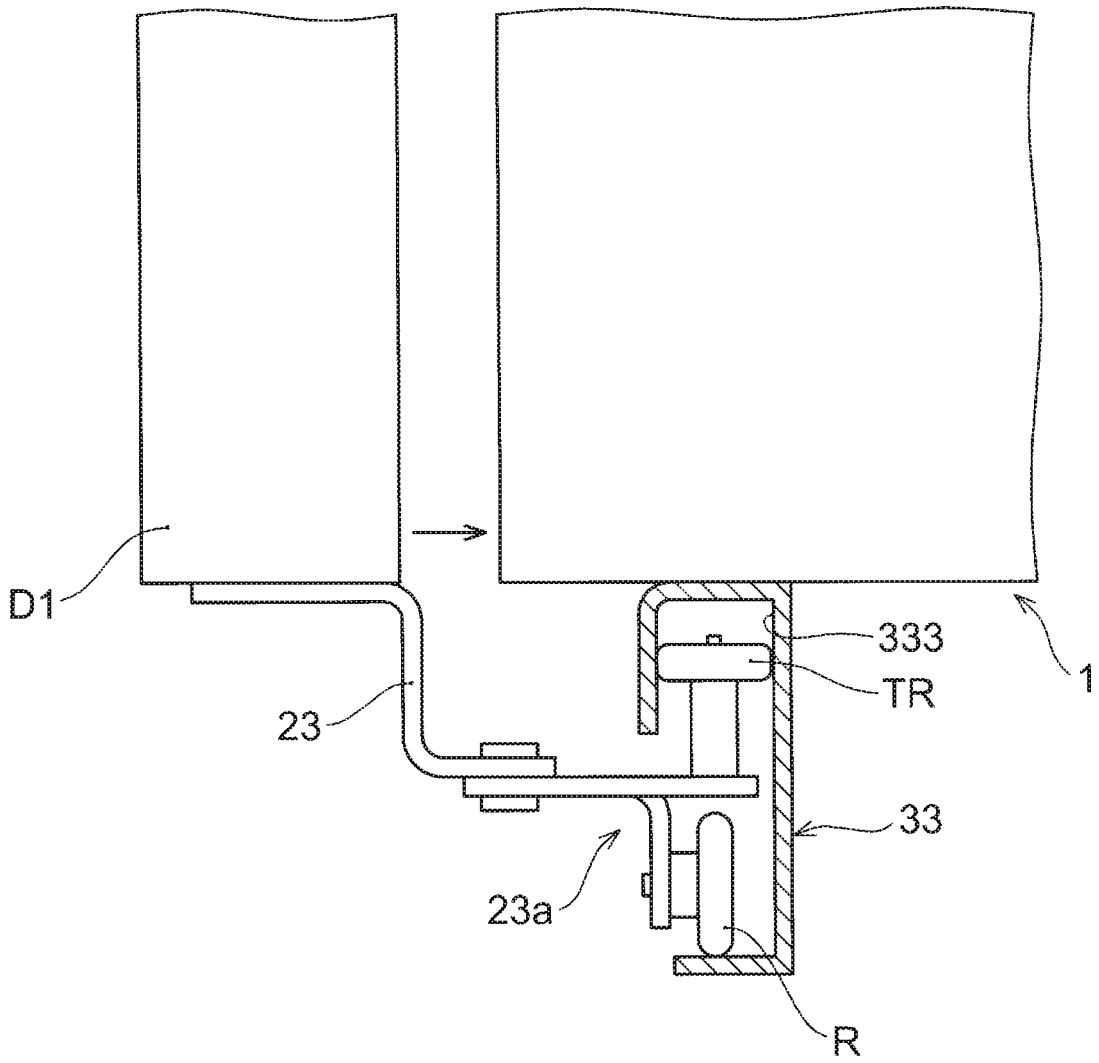
FIG. 12 is a view illustrating a state where a fifth connecting portion is connected to a third guide member provided under the opening and closing mechanism for opening and closing bodies of FIG. 1.

Further, in this embodiment, as shown in FIG. 12, the third guide member 33 is provided at a position where the fifth connecting portion 23*a* presses the third guide member 33. Since the fifth connecting portion 23*a* is provided at the position for pressing the third guide member 33, swinging of the opening and closing body D can be prevented even in the case where a rotation moment with the first and second guide members 31, 32 as a fulcrum at upper side of the opening member 1 around an axis parallel with the moving direction X is applied to the opening and closing body D. Namely, in the case where a rotation moment is applied to the opening and closing bodies D and a force in a direction in which the lower end side of the opening and closing body D approaches to the opening member 1 as shown by an arrow in FIG. 12 is applied, the fifth connecting portion 23*a* presses the third guide member 33 to restrict movement of the opening and closing body D. This can suppress swinging of a lower end of the opening and closing body D, and the opening and closing body D can move more smoothly. Note that, the same configuration applies to the sixth connecting portion 24*a*. Further, in this embodiment, the third guide member 33 is disposed at a side closer to the opening and closing body D than the first and second guide members 31, 32. Therefore, a back surface 333 of the third guide member 33 is pressed by the thrust rollers TR of the fifth and sixth connecting portions 23*a*, 24*a*, and swinging of the lower end of the opening and closing body D is suppressed.

Second Embodiment

Next the second embodiment of an opening and closing mechanism for opening and closing bodies will be explained. In the above-described embodiment, the opening and closing mechanism for opening and closing bodies in which the opening and closing body is opened and closed manually is shown. On the other hand, in the opening and closing mechanism for opening and closing bodies of the second embodiment, the opening and closing body is electrically opened and closed. Note that, points common to the first embodiment will be omitted and points different from the first embodiment will be mainly explained.

In the opening and closing mechanism for opening and closing bodies of the second embodiment, connecting portions having rolling elements are moved along guide members by a drive mechanism using a control cable, and therefore opening and closing body is opened and closed. Hereinafter, the case of opening the first opening and closing body D1 will be explained as an example.

Figure 13:
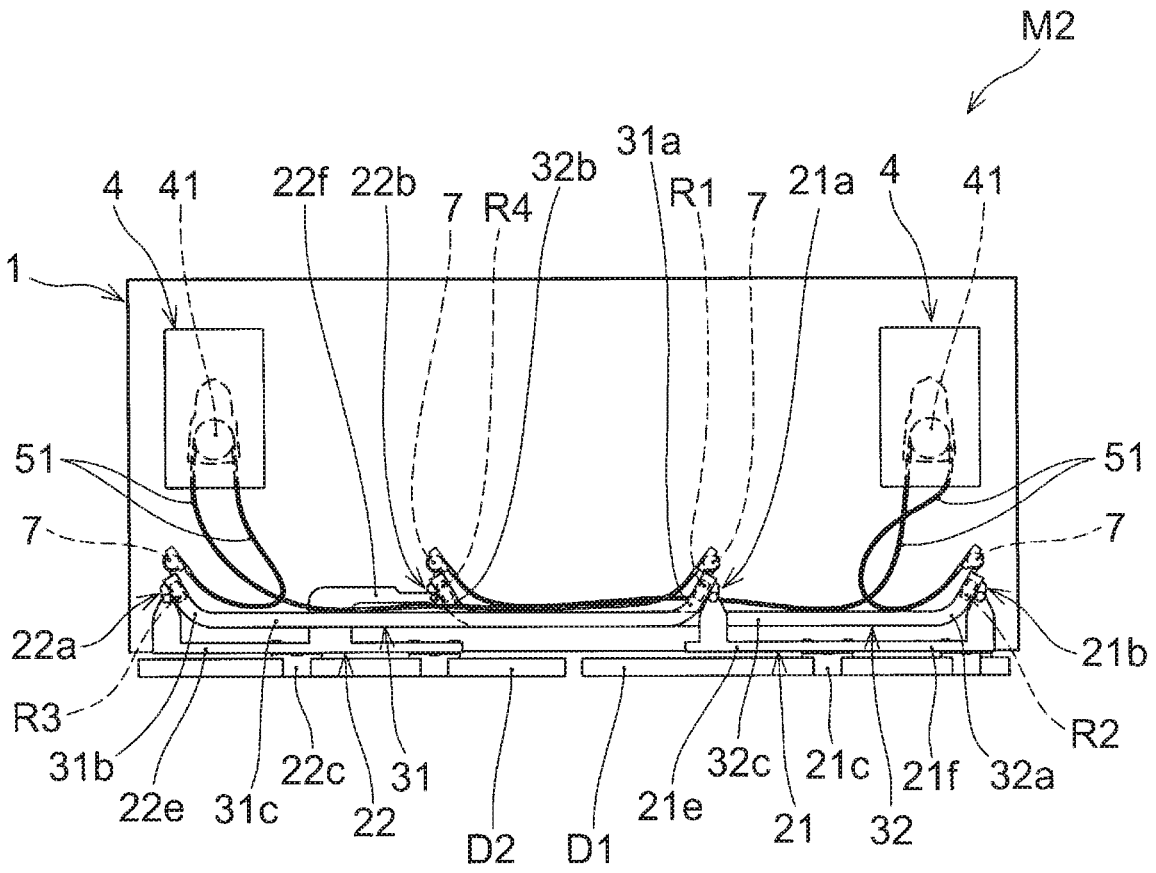
FIG. 13 is a schematic top view of an opening and closing mechanism for opening and closing bodies according to a second embodiment of the present invention.
Figure 14:
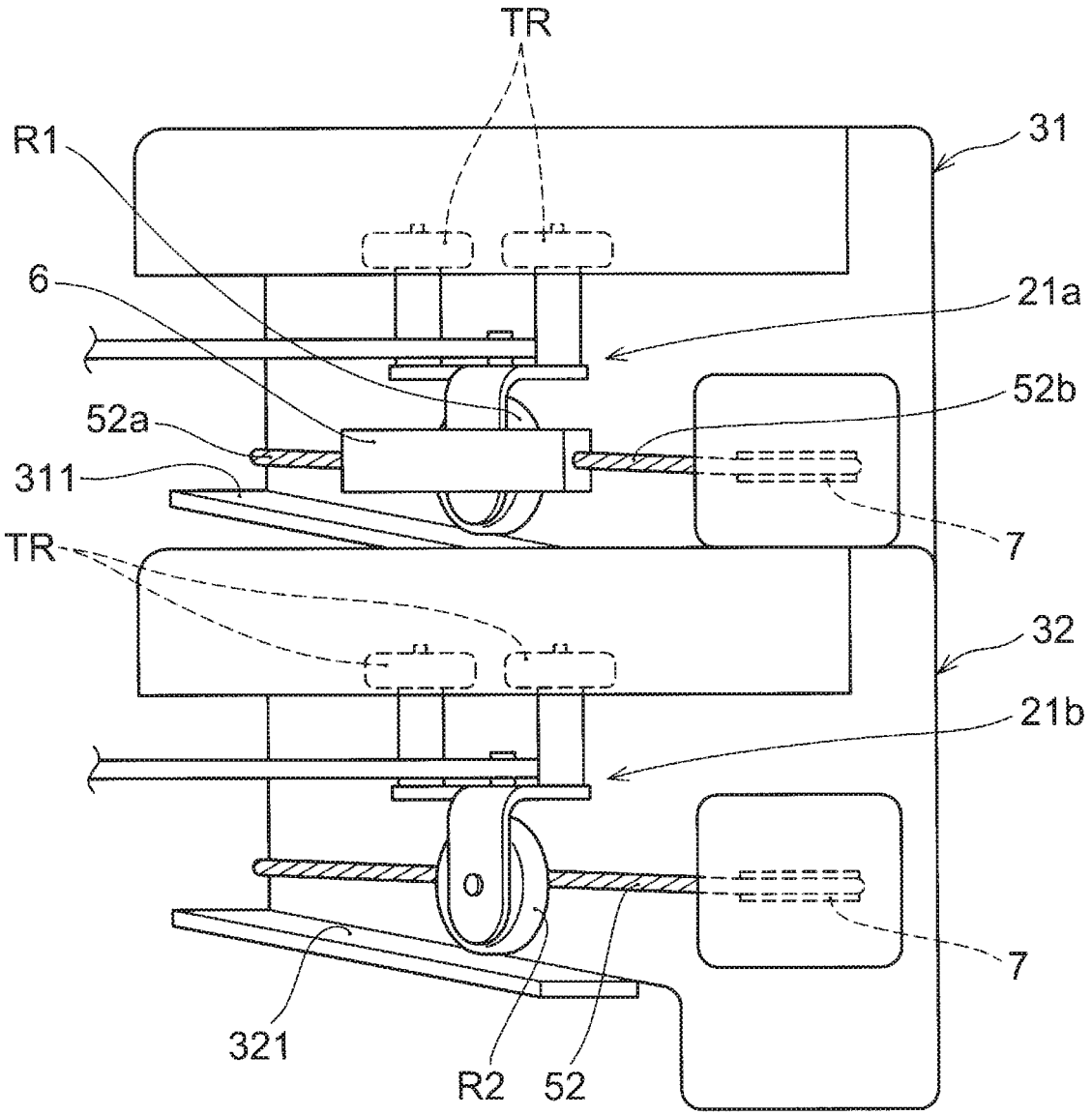
FIG. 14 is a schematic view of a moving member used for the opening and closing mechanism for opening and closing bodies of FIG. 13.

The opening and closing mechanism M2 for opening and closing bodies of the second embodiment comprises, as shown in FIG. 13, a drive section 4 and a control cable including an outer casing 51 and an inner cable 52 (see FIG. 14) slidably housed in the outer casing 51. The outer casing 51 extends between the drive section 4 and the both ends of the first guide member 31. Further, as shown in FIG. 14, the opening and closing mechanism M2 for opening and closing bodies comprises a moving member 6 which moves along the first guide member 31 by the inner cable 52 driven by the drive section 4 and is connected to the first connecting portion 21*a*, and moves the first connecting portion 21*a* along the first guide member 31. Note that, in this embodiment, the moving member 6 is connected to the first connecting portion 21*a*, it may be connected to the third connecting portion 22*a*.

In this embodiment, as shown in FIG. 14, the moving member 6 is operated with a first inner cable 52*a* and a second inner cable 52*b*, and each one end of the first inner cable 52*a* and the second inner cable 52*b* is connected to the moving member 6 and each another end of the first inner cable 52*a* and the second inner cable 52*b* is connected to a drum 41 provided on the drive section 4. The first and second inner cables 52*a*, 52*b* are routed along the first guide member 31, the directions thereof are changed by direction-changing members 7 such as a pulley at ends of the first guide member 31, and the first and second inner cables 52*a*, 52*b* extend inside the outer casing 51 toward the drive section 4. In this embodiment, the drive section 4 comprises an electric motor (not shown) for rotationally driving the drum 41. When the motor is actuated, the first and second inner cables 52*a*, 52*b* are wound up and wound off by rotation of the drum 41, and the moving member 6 moves along the first guide member 31. When the moving member 6 moves along the first guide member 31, the rolling element R1, which is connected to the moving member 6, of the first connecting portion 21*a* rolls along the first guide member 31 and the first support member 21 moves, and thus, the first opening and closing body D1 moves. In this case, the rolling element R2 of the second connecting portion 21*b* of the first support member 21 follows the movement of the rolling element R1 driven by the moving member 6. The opening and closing of the second opening and closing body D2 are performed in the same manner as in the first opening and closing body D1. The operation of the motor is performed by operation of a switch and a sensor which are not shown in the drawing by a user.

As described above, by electrically driving the rolling elements R, the opening and closing mechanism for opening and closing bodies of this embodiment can provide easy and smooth movement of the opening and closing bodies D in addition to the effects described in the first embodiment. The opening and closing mechanism for opening and closing bodies of this embodiment is suitable particularly for the case where heavy opening and closing bodies of a refrigerator for business use, a freezer for business use and the like are opened and closed.

EXPLANATION OF SYMBOLS

1 Opening member
11 First opening
12 Second opening
21 First support member
21*a* First connecting portion
21*b* Second connecting portion
21*c* First mounting portion
21*d* Auxiliary mounting portion
21*e* First extending portion
21*f* Second extending portion
22 Second support member
22*a* Third connecting portion
22*b* Fourth connecting portion
22*c* Second mounting portion
22*d* Auxiliary mounting portion
22*e* Third extending portion
22*f* Fourth extending portion
23 Third support member
23*a* Fifth connecting portion
24 Fourth support member
24*a* Sixth connecting portion
3 Guide member
31 First guide member
31*a* First closed position guide portion
31*b* Second closed position guide portion
31*c* First guide member intermediate portion
32 Second guide member
32*a* Third closed position guide portion
32*b* Fourth closed position guide portion
32*c* Second guide member intermediate portion
33 Third guide member
311, 321 Rolling surface
312, 322 Engaging portion
313, 323, 333 Back surface
314 Top surface
4 Drive section
41 Drum
51 Outer casing
52 Inner cable
52*a* First inner cable
52*b* Second inner cable
6 Moving member
7 Direction-changing member
B Base portion
D Opening and closing body
D1 First opening and closing body
D2 Second opening and closing body
H Pulling handle
M, M2 Opening and closing mechanism for opening and closing bodies
OL Overlapping region
Partition portion
R, R1, R2, R3, R4 Rolling element (radial roller)
TR Thrust roller
X Moving direction of an opening and closing body
Y Up-and-down direction
Z Front-back direction

What is claimed is:

1. An opening and closing mechanism for opening and closing bodies comprising;

an opened member having a first opening and a second opening;

a first opening and closing body being movable between an opened position where the first opening is opened and a closed position where the first opening is closed:

a second opening and closing body being movable between an opened position where the second opening is opened and a closed position where the second opening is closed:

a first support member for supporting the first opening and closing body, the first support member mounted to the first opening and closing body:

a second support member for supporting the second opening and closing body, the second support member mounted to the second opening and closing body: and guide members provided to the opened member and guiding the first opening and closing body and the second opening and closing body via the first support member and the second support member, respectively, such that each of the first opening and closing body and the second opening and closing body is reciprocally movable between the opened position and the closed position, wherein the guide members have a first guide member and a second guide member, each of the first guide member and the second guide member extending from the first opening side to the second opening side of the opened member, the first support member has a first connecting portion connected to the first guide member so as to be movable relative the first guide member and a second connecting portion connected to the second guide member so as to be movable relative to the second guide member, the second support member has a third connecting portion connected to the first guide member so as to be movable relative to the first guide member and a fourth connecting portion connected to the second guide member so as to be movable relative to the second guide member, the first guide member has a first closed position guide portion guiding the first connecting portion so that the first opening and closing body moves to the closed position where the first opening is closed, a second closed position guide portion guiding the third connecting portion so that the second opening and closing body moves to the closed position where the second opening is closed, and a first guide member intermediate portion connected to the first closed position guide portion and the second closed position guide portion, the first connecting portion and the third connecting portion being movable on the first guide member intermediate portion, the second guide member has a third closed position guide portion guiding the second connecting portion so that the first opening and closing body moves to the closed position where the first opening is closed, a fourth closed position guide portion guiding the fourth connecting portion so that the second opening and closing body moves to the closed position where the second opening is closed, and a second guide member intermediate portion connected to the third closed position guide portion and the fourth closed position guide portion, the second connecting portion and the fourth connecting portion being movable on the second guide member intermediate portion, the first guide member intermediate portion and the second guide member intermediate portion are disposed in parallel with each other and are disposed to have an overlapping region, in the overlapping region, one of the first guide member intermediate portion and the second guide member intermediate portion is arranged, with respect to the other of the first guide member intermediate portion and the second guide member intermediate portion, in a direction to which a load from the first opening and closing body and the second opening and closing body via each of the connecting portions is applied, each of the first connecting portion, the second connecting portion, the third connecting portion and the fourth connecting portion has a rolling element provided at a side so as to apply a load toward the guide members, and the first support member and the second support member are mounted at positions where, when one of the first opening and closing body and the second opening and closing body is located at the closed position, the other of the first opening and closing body and the second opening and closing body is movable in a double-sliding manner.

2. The opening and closing mechanism for opening and closing bodies of claim 1, wherein the first support member has a first mounting portion to be mounted to the first opening and closing body, and a first extending portion extending from the first connecting portion in a direction in which the first mounting portion is away from the first guide member when the first opening and closing body is located at the closed position, and the second support member has a second mounting portion to be mounted to the second opening and closing body, and a fourth extending portion interposed between the second mounting portion and the fourth connecting portion and provided so as to extend across the first extending portion in a moving direction of the second opening and closing body when the second opening and closing body is located at the opened position.

3. The opening and closing mechanism for opening and closing bodies of claim 1, wherein the first connecting portion and the second connecting portion are mounted over the first opening and closing body, the third connecting portion and the fourth connecting portion are mounted over the second opening and closing body, and the first guide member and the second guide member are disposed being overlapped each other in an up-and-down direction.

4. The opening and closing mechanism for opening and closing bodies of claim 1, wherein each of the first connecting portion, the second connecting portion, the third connecting portion and the fourth connecting portion comprises a radial roller receiving a load in a vertical direction and a thrust roller receiving a load in a horizontal direction.

5. The opening and closing mechanism for opening and closing bodies of claim 1, wherein the opened member is provided with third guide member at an opposite side of the opened member to a side at which the first guide member and the second guide member are provided, the first opening and closing body is provided with a third support member having a fifth connecting portion connected the third guide member, the third support member being mounted at an opposite position to a position at which the first support member is mounted, the second opening and closing body is provided with a fourth support member having a sixth connecting portion connected to the third guide member, the fourth support member being mounted at an opposite position to a position at which the second support member is mounted, and the third guide member is provided at a position where the fifth connecting portion and the sixth connecting portion press the third guide member.

* * * * *